US005212344A

United States Patent [19]

Kageyama et al.

[11] Patent Number: 5,212,344

[45] Date of Patent: May 18, 1993

[54] DEVELOPING APPARATUS AND MANUFACTURING METHOD OF DEVELOPING ROLLER

[75] Inventors: Hiroshi Kageyama, Osaka; Yoshihiko Tanaka, Moriguchi, both of Japan

[73] Assignee: Mita Industrial Co., Ltd., Osaka, Japan

[21] Appl. No.: 722,158

[22] Filed: Jun. 27, 1991

[30] Foreign Application Priority Data

Jul. 9, 1990 [JP] Japan ..... 2-181716

[51] Int. Cl.[5] ..... G03G 15/09

[52] U.S. Cl. ..... 118/658; 355/246; 355/251

[58] Field of Search ..... 355/251, 253, 246, 208; 118/656, 657, 658

[56] References Cited

U.S. PATENT DOCUMENTS

| | | | |
|---|---|---|---|
| 4,168,481 | 9/1979 | Harada et al. | 355/284 |
| 4,653,427 | 3/1987 | Hosaka et al. | 118/658 |
| 4,851,872 | 7/1989 | Murasaui et al. | 355/253 |
| 4,868,601 | 9/1989 | Morimoto et al. | 355/208 |
| 4,980,728 | 12/1990 | Funayama et al. | 355/251 |
| 4,982,691 | 1/1991 | Asanuma et al. | 118/658 |

*Primary Examiner*—A. T. Grimley
*Assistant Examiner*—Christopher Horgan
*Attorney, Agent, or Firm*—Beveridge, DeGrandi, Weilacher & Young

[57] ABSTRACT

A developing apparatus includes a developing roller having a magnet roller for feeding a developer to a photoconductor, and a toner concentration sensor for detecting a toner concentration of the developer, a region of the magnet roller corresponding to a location of the toner concentration sensor, being substantially zero gauss as magnetic flux density distribution.

7 Claims, 7 Drawing Sheets

DEVELOPING APPARATUS AND MANUFACTURING METHOD OF DEVELOPING ROLLER

BACKGROUND OF THE INVENTION

1. Field of the Invention

The present invention relates to a developing apparatus possessing a magnet roller and having a developing roller for feeding a developer to a photoconductor, and a manufacturing method of a developing roller.

2. Description of the Prior Art

The developing apparatus used in a conventional copier comprises an agitation roller for stirring the developer, a developing roller for feeding the developer to a photoconductor, a feed roller for feeding the developer to the developing roller, an ear cutter or developer height regulator for defining the developer depositing on the developing roller, and a toner concentration sensor. Specifically the developing roller consists of, as shown in FIG. 1, a magnet roller 11, a nonmagnetic sleeve 12 disposed on the surface of the magnet roller 11, and others. This magnet roller 11 possesses plural magnetic poles N1, N2, S1, S2, S3 for feeding the developer to the photoconductor 7. These plural magnetic poles individually adsorb and convey the developer, and form magnetic brushes, which are eared states of the developer, in the area near the photoconductor 7. The magnetic flux density distribution is as shown in the diagram. A toner concentration sensor 10 is disposed above between the magnetic poles S1 and N2 in this magnetic flux density distribution.

The toner concentration sensor 10 is a detector of the toner concentration of the developer passing nearby, and various types are known. For example, incorporating a coil, by detecting the fluctuation of the inductance (L) of the coil by the developer passing nearby, the toner concentration of the developer is detected.

This type of toner concentration sensor 10 is, as a matter of fact, influenced by magnetism. That is, if the toner concentration sensor 10 is present within the magnetic field, an error is caused in the output due to the effect of the magnetic field although the toner concentration is the same.

In the conventional toner concentration sensor 10, as shown in the diagram, the magnetic field in which the toner concentration sensor 10 is present is not zero gauss but possesses a specific magnetic flux density, and therefore the toner concentration output is inaccurate. As a result, the toner concentration is controlled on the basis of this inaccurate toner concentration output, and copies of poor picture quality are made.

Meanwhile, as mentioned above, the magnetic flux density distribution is as shown in FIG. 2, and when the ear cutter or developer height regulator 8 for cutting the ear of the developer is disposed between the magnetic poles S1 and N2 in the magnetic flux density distribution, the developer on the surface of the sleeve 12 of the developing roller 6 beneath the developer height regulator 8 is in an eared state because this location is not zero gauss but possesses a specific magnetic flux density. Supposing the humidity or the toner density varies, a difference is caused in the amount of earning of the developer. Therefore, the earning state of the developer is unstable, and the amount of the developer cut off by the developer height regulator 8 and supplied into the photoconductor is not constant. Hence, the quantity of the toner supplied on the photoconductor 7 is not constant.

Moreover since the magnetic poles involve fluctuations as manufacturing errors, the magnetic flux density may be much higher in a region beneath the developer height regulator 8. In this case, the developer ears up higher, and the cutting amount by the developer height regulator 8 differs greatly every time, and the toner quantity supplied on the photoconductor 7 becomes more and more unstable.

SUMMARY OF THE INVENTION

It is an object of the present invention to offer a developing apparatus in which the region of the magnetic roller corresponding to the position of the location of the toner concentration sensor is substantially zero gauss, so that picture density failure due to instability of the toner concentration sensor may be prevented.

The developing apparatus of the present invention comprises;

a developing roller having a magnet roller for feeding a developer to a photoconductor, a toner concentration sensor for detecting a toner concentration of the developer, a region of the magnet roller corresponding to a location of the toner concentration sensor, being substantially zero gauss as magnetic flux density distribution.

The manufacturing method of the present invention, of developing roller possessing a magnet roller for feeding a developer to a photoconductor is that;

when forming plural magnetic poles for adsorbing the developer at specified positions of the magnet roller by a magnetic flux density distribution of plural magnetic field generating means, the magnetic flux density distribution is controlled by using other magnetic field generating means in order to set substantially zero gauss in a region of the magnet roller corresponding to a location of the toner concentration sensor for detecting the toner concentration of the developer, between the plural magnetic poles.

And it is an object of the present invention to offer a developing apparatus in which the region of the magnetic roller corresponding to the position of the location of the developer height regulator is substantially zero gauss, so that toner density failure of picture due to toner carrying instability may be prevented.

The developing apparatus of the present invention comprises;

a developing roller having a magnet roller for feeding a developer to a photoconductor, an developer height regulator for defining the developer to be supplied to the photoconductor, a region of the magnet roller corresponding to a location of the developer height regulator, being substantially zero gauss as magnetic flux density distribution.

The manufacturing method of the present invention, of developing roller possessing a magnet roller for feeding a developer to a photoconductor, is that when forming plural magnetic poles for adsorbing the developer at specific positions on the magnet roller by a magnetic flux density distribution of plural magnetic field generating means, the magnetic flux density distribution is defined by using other magnetic field generating means for setting substantially zero gauss in a region of the magnet roller corresponding to a location of the developer height regulator for cutting off the developer, between the plural magnetic poles.

DESCRIPTION OF THE PREFERRED EMBODIMENT

Figure 1:
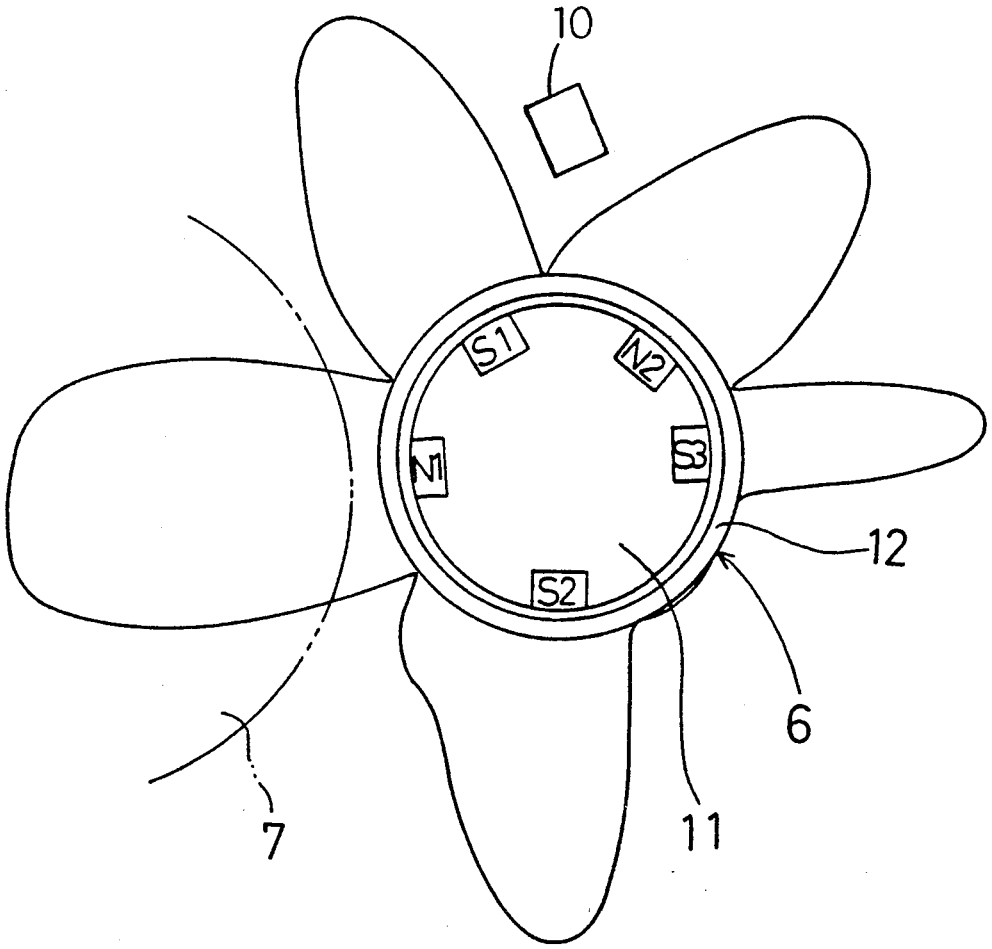
FIG. 1 (PRIOR ART)
FIG. 1 is a diagram showing the magnetic flux density distribution of a conventional developing roller.
Figure 2:
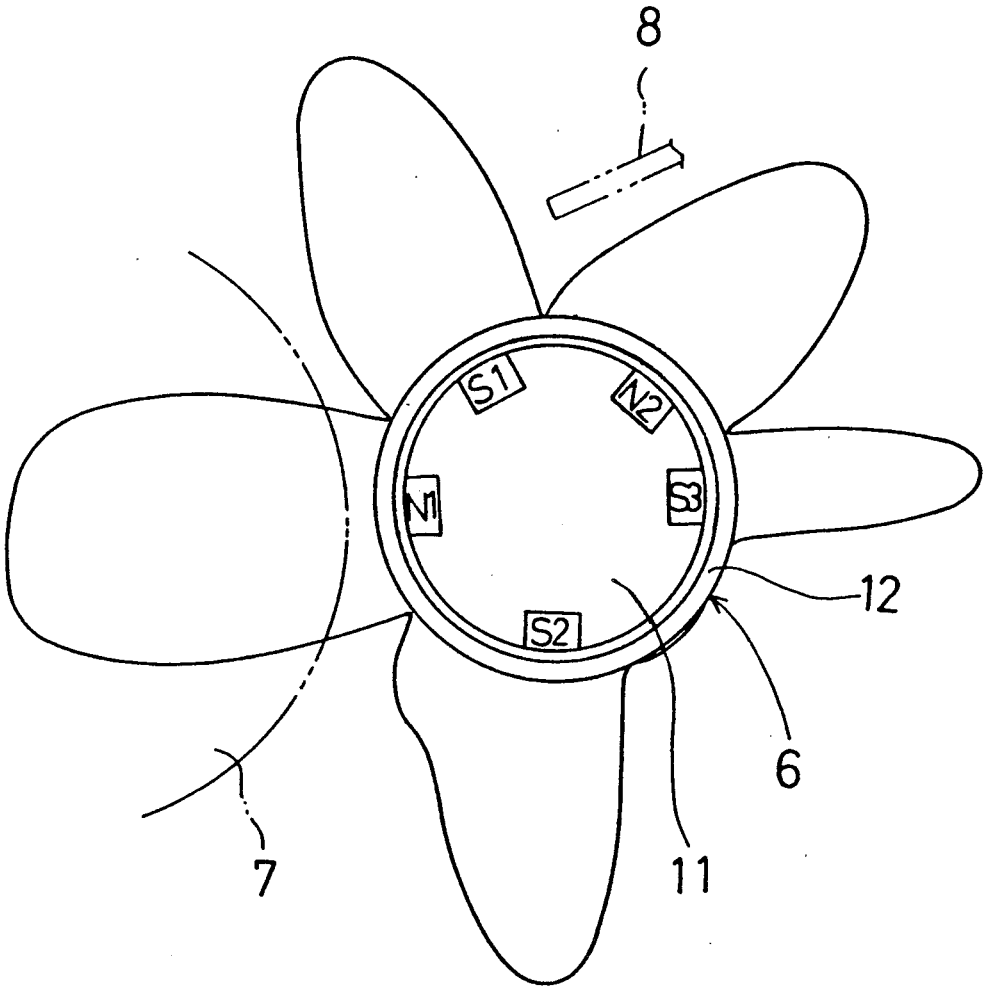
FIG. 2 (PRIOR ART)
FIG. 2 is a diagram showing the magnetic flux density distribution of a conventional developing roller.

Referring now to the drawings, one of the preferred embodiments of the inventions is described in detail below.

Figure 3:
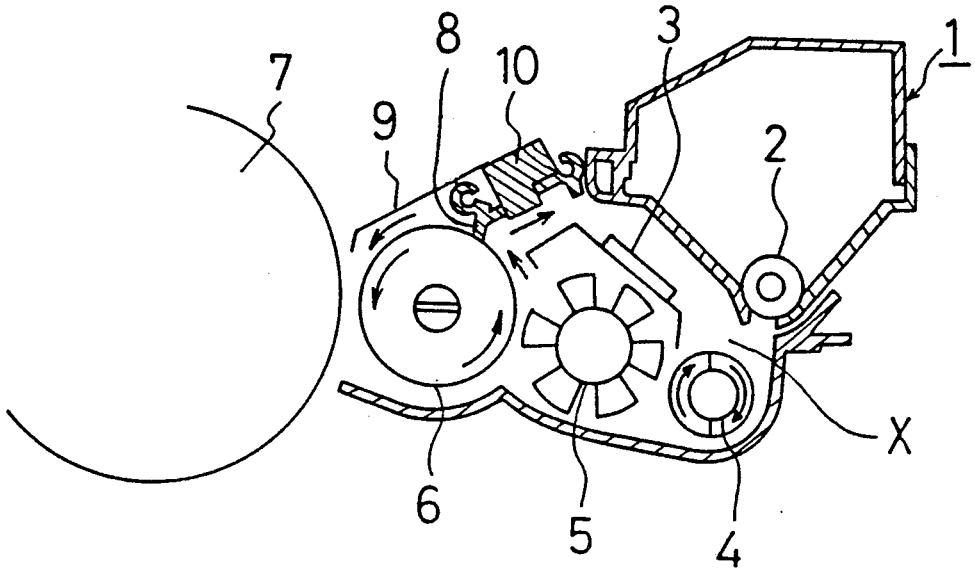
FIG. 3 is a schematic sectional view of a developing apparatus in an embodiment of the present invention.

FIG. 3 is a schematic sectional view of an embodiment of the developing apparatus of the present invention.

Generally, an image forming of an image forming apparatus such as copier comprises a charging step for charging the photoconductor, an exposure step for illuminating the photoconductor to form an electrostatic latent image, a developing step for adsorbing the toner on the electrostatic latent image, a transfer step for transferring the developed toner image on a paper, a fixing step for fixing the transferred toner image on the paper, and a cleaning step for removing the residual toner from the photoconductor surface. The structure of the developing apparatus in the developing step for adsorbing the toner on the electrostatic latent image is as shown in FIG. 3. That is, in FIG. 3, at an oblique upward position in the developing apparatus 1, a toner refill roller 2 for supplementing the toner is provided. Beneath the toner refill roller 2, there is an agitation roller 4 for stirring the developer X (composed of toner and carrier) returned from a partition board 3 and the toner from the toner refill roller 2. The developer X agitated by this agitation roller 4 is supplied to a developing roller 6 by a feed roller 5, which is disposed at the side of the agitation roller 4, and the developing roller 6 is located near the photoconductor 7. In the upper part of the developing apparatus 1, an developer height regulator 8, a developing slit plate 9, and a toner concentration sensor 10 are provided.

Figure 4:
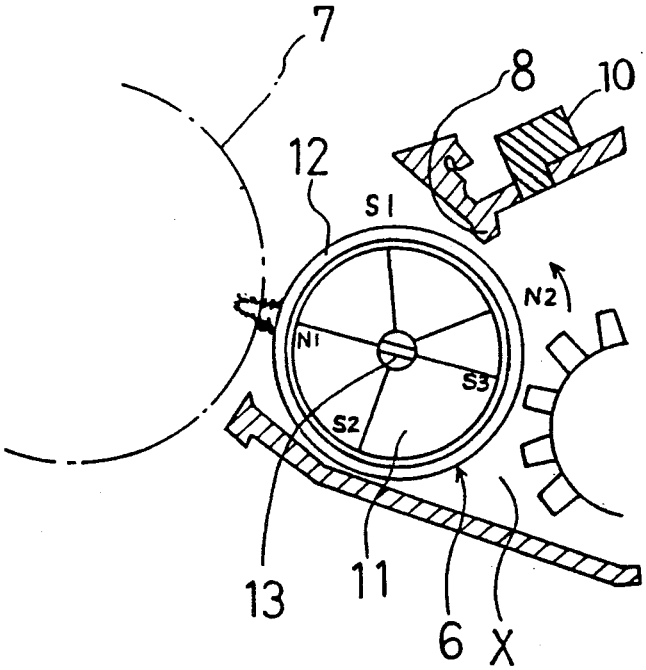
FIG. 4 is a schematic sectional view of a developing roller in the same embodiment.

More specifically, the developing roller 6 comprises, as shown in FIG. 4, a fixed magnet roller 11 possessing five different magnetic poles S3, N2, S1, N1, S2 and a rotating tubular sleeve roller 12 surrounding this roller 11. Between the two magnetic poles N2 and S1, the developer height regulator 8 is disposed. The developer height regulator 8 cuts off the ear of the developer X, and supplies a specific amount of developer X to the photoconductor 7. To this developer height regulator 8, the toner concentration sensor 10 is fixed. As shown in the magnetic flux density distribution in FIG. 5, region A of the magnet roller 11 located at the lower side of the toner concentration sensor 10 is substantially zero gauss. Thus, by setting this place as zero gauss region, the toner concentration sensor 10 can accurately detect the concentration of the developer without being affected by the magnetic field.

Figure 5:
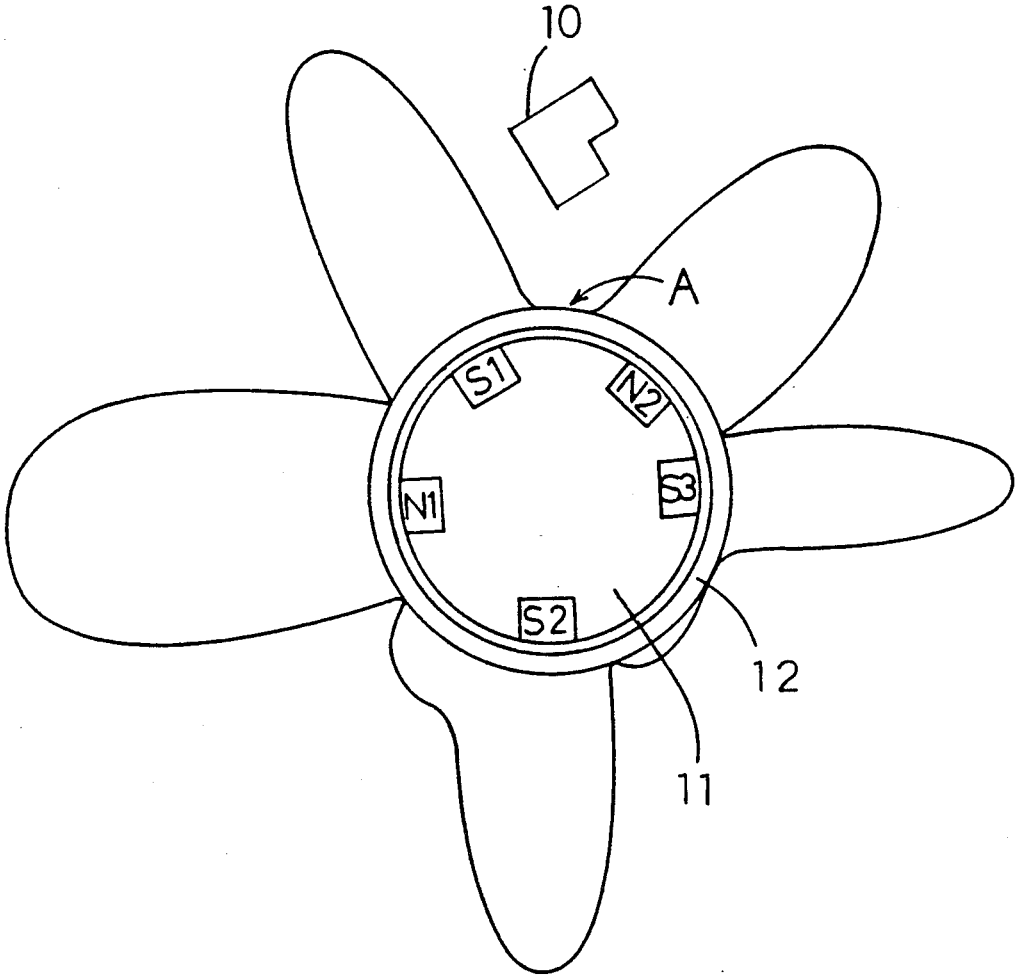
FIG. 5 is a diagram showing the magnetic flux density distribution of the developing roller in the same embodiment.

Referring to FIG. 4 and FIG. 5, the operation of this developing roller 6 is described below.

In FIG. 4, near the magnetic poles S3–N2, the developer X is adsorbed on the sleeve roller 12 from the feed roller 5 by the magnet roller 11. In the vicinity of the ear cutting portion from before the ear cutting side of the developer X by the developer height regulator 8 (Between magnetic poles N2 and S1), that is, in the area of location of the toner concentration sensor 10, the magnet roller 11 is substantially in a zero gauss region in its corresponding area. Therefore, the toner concentration sensor 10 can detect the toner concentration of the developer accurately without being effected by the magnetic field. The developer X is ear cut by the developer height regulator 8 and being held on the sleeve roller 12, and sent toward the magnetic pole N1. At the magnetic pole N1, the developer X is linked like a string to form a vertical brush-like ear. and the photoconductor 7 is rubbed by its ear tip. As a result, the toner of the developer is attracted and adsorbed by the charged photoconductor 7. Sequentially, the developer lowered in the toner concentration is sent backward by conveying the developer X on the sleeve roller 12 by the magnetic pole S2. Finally, between the magnetic poles S2 and S3, the developer X is separated off.

The manufacturing method of this developing roller 6 is described below.

In the first method, when assembling the magnetic poles of the magnet roller 11 sequentially on a circumference, the distance between the magnetic pole S1 and the magnetic pole N2 is sufficiently spaced so that the region of the magnet roller 11 corresponding to the location of the toner concentration sensor 10 may be substantially zero gauss.

By thus disposing the magnetic poles, the region of the magnet roller 11 corresponding to the location of the toner concentration sensor 10 may be substantially set to zero gauss.

Another manufacturing method of developing roller 6 is explained below.

The magnet roller 11 is first formed into one body from a mixture of magnetic powder and synthetic resin powder.

Figure 6:
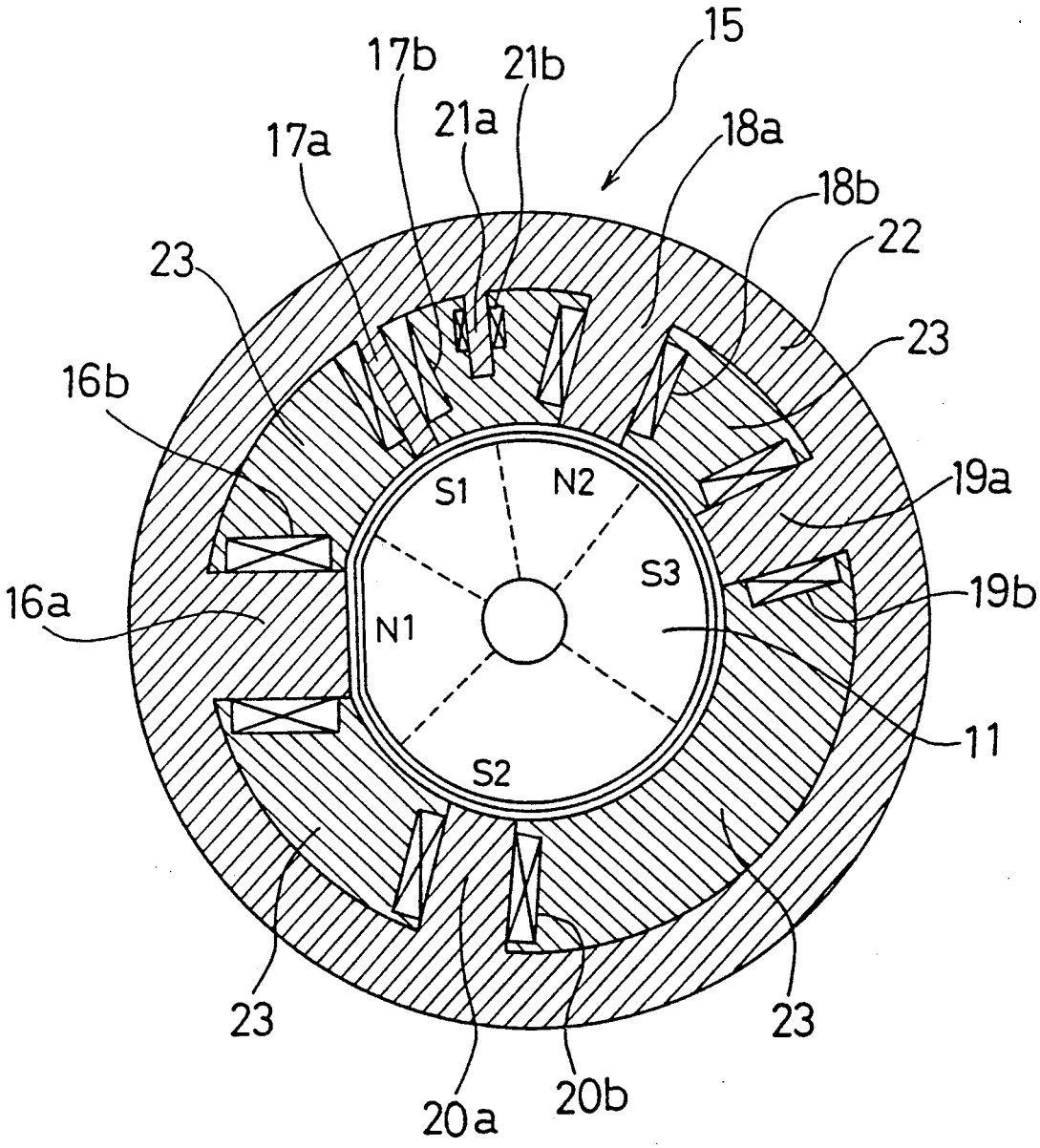
FIG. 6 is a sectional view of a magnetizing apparatus for manufacturing the developing roller in the same embodiment.
Figure 7:
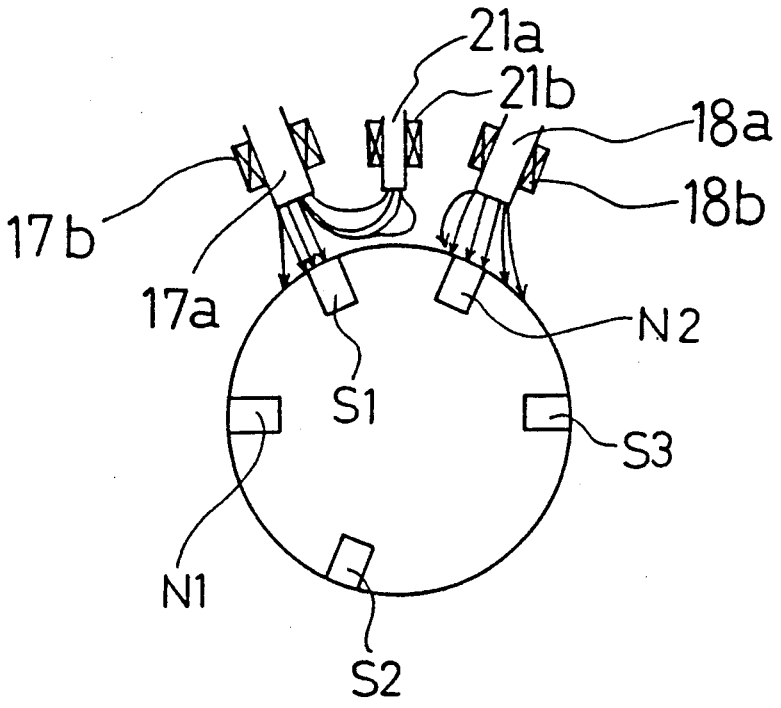
FIG. 7 is a conceptual diagram showing magnetization of the developing roller in the same embodiment.

FIG. 6 is a sectional view of a magnetizing apparatus 15 for simultaneously magnetizing five positions of the formed magnet roller 11, and forming a region of substantially zero gauss between the magnetic poles N2 and S1. In this diagram, soft iron electromagnetic yoke **16*a* and electromagnetic coil 16*b* are parts for magnetizing the magnet roller 11 with N1 pole, soft iron electromagnetic yoke 17*a* and electromagnetic coil 17*b* are parts for magnetizing the magnet roller 11 with S1 pole, soft iron electromagnetic yoke 18*a* and electromagnetic coil 18*b* are parts for magnetizing the magnet roller 11 with N2 pole, soft iron electromagnetic yoke 19*a* and electromagnetic coil 19*b* are parts for magnetizing the magnet roller 11 with S3 electrode, and soft iron electromagnetic yoke 20*a* and electromagnetic coil 20*b* are parts for magnetizing the magnet roller 11 with S2 electrode. Moreover, soft iron electromagnetic yoke 21*a* and electromagnetic coil 21*b* are N or S poles, and are provided in order to produce a substantially zero gauss region between the N2 and S1 poles of the magnet roller 11, and also to define the line of magnetic force when magnetizing the N2 and S1 poles. In defining the line of magnetic force, as shown in FIG. 7, when magnetizing, the line of magnetic force one of the magnetic poles S1 and N2 is attracted by the soft iron electromagnetic yoke 21***a* and electromagnetic coil 21*b*, and the line of magnetic force of the other magnetic pole is repelled. The substantially zero gauss region may be optimized by properly considering the height of the soft iron electromagnetic yoke 21*a* and electromagnetic coil 21*b*, interval of the S1, N2 poles to be magnetized, current magnitude, and shape.

In this way, as shown in the magnetic flux density distribution in FIG. 5, a substantially zero gauss region (arrow A) is formed between the poles N2 and S1.

Numeral 22 is a magnetic path yoke for connecting the magnetic paths of electromagnetic yokes, and 23 is a spacer made of resin for supporting the magnet roller 11.

Thus, the magnet roller 11 after forming is accommodated in the magnetizing apparatus 15, and the magnetic poles N1, N2, S1, S2, S3 corresponding to the positions on its outer circumference are magnetized, and also a substantially zero gauss region is formed. The magnetized magnet roller 11 is, after a stainless steel shaft 13 is press-fitted in, stored and fixed in the sleeve roller 12 as shown in FIG. 4.

The magnet roller of fixed type is described above, but it may be also of rotary type.

Meanwhile, the toner concentration sensor of the invention is not limited to the inductance detection type, but other type may be employed as far as it is subjected to effects of magnetic field.

In the invention, since the region of the magnet roller corresponding to the toner concentration roller is substantially zero gauss, the toner concentration sensor can detect the concentration of the developer accurately without being affected by the magnetic field, so that the toner concentration may be controlled correctly, thereby preventing defective development.

Another embodiment of the invention is described below while referring to FIGS. 4 and 8, the drawing showing its embodiment.

As mentioned above, the developing roller 6 is composed of, as shown in FIG. 4, the fixed magnet roller 11 having five different magnetic poles S3, N2, S1, N1, S2 and the rotating sleeve roller 12.

Figure 8:
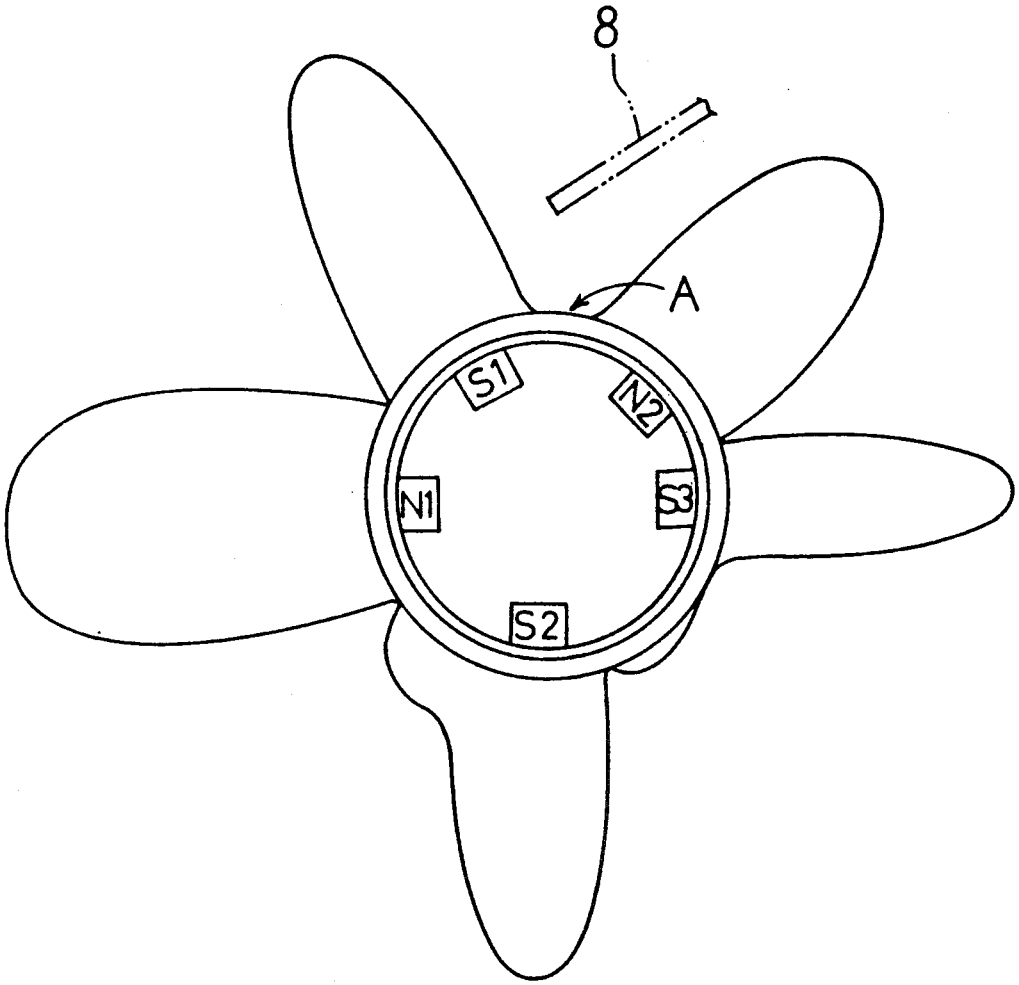
FIG. 8 is a diagram showing the magnetic flux density distribution of the developing roller in another embodiment of the present invention.

The developer height regulator 8 is disposed between two magnetic poles N2, S1, as shown in FIG. 8. This developer height regulator 8 cuts off the ear from the developer X and supplies a specific amount of developer X into the photoconductor 7. The region of the magnet roller 11 positioned at the lower side of this developer height regulator 8 is substantially zero gauss as the magnetic flux density distribution is shown in FIG. 8. Thus, by setting the zero gauss region, the developer X is in stable state without earning. Therefore, after being cut off by the developer height regulator 8, the developer X is constantly supplied into the photoconductor 7.

The operation of this developing roller 6 is described below.

In FIG. 4, near the magnetic poles S3, N2, the developer X is adsorbed on the sleeve roller 12 by the magnet roller 11. In the vicinity of the part (between magnetic poles N2 and S1) for ear cutting from before the ear cutting side of the developer X by the ear cutter 8, the magnet roller 11 is is substantially in zero gauss region, and the developer X does not ear up, and the developer X is properly cut off, and conveyed. Through the developer height regulator 8, the developer X is conveyed being held on the sleeve roller 12, and is sent toward the magnetic pole N1. In the magnetic pole N1. The developer X is linked like a string to form a brush-like vertical ear, and the photoconductor 7 is rubbed against by its ear tip. In consequence, the toner is attracted and adsorbed on the charged photoconductor 7. To convey the developer lowered in the toner concentration backward, the developer X is conveyed on the sleeve roller 12 by the magnetic pole S2. Between the magnetic poles S2 and S3, the developer X is separated off.

Concerning the manufacturing method of the developing roller 6, it is possible to manufacture in the same manner as shown in FIG. 6. In this case, needless to say, the position of the substantial zero gauss region is designed to correspond to the position of the developer height regulator 8.

In the invention, thus, since the region of the magnetic controller corresponding to the developer height regulator is substantially zero gauss, the developer is properly cut off by the ear cutter without extreme earning, and quantitative deviation avoided, and defective development due to improper toner conveyance may be prevented.

Meanwhile, the above mentioned "magnetic field generating means" of these present inventions are not limited to the soft iron electromagnetic yoke 16*a*, electromagnetic coil 16*b*, soft iron electromagnetic yoke 17*a*, electromagnetic coil 17*b*, soft iron electromagnetic york 18*a*, electromagnetic coil 18*b*, soft iron electromagnetic yoke 19*a*, electromagnetic coil 19*b*, soft iron electromagnetic yoke 20*a* and electromagnetic coil 20*b* as shown in the foregoing embodiment, but other magnetic field generating means may be also employed.

And the above mentioned "other magnetic field generating means" of these present inventions may not be limited to the soft iron electromagnetic yoke 21*a* and electromagnetic coil 21*b* as in the foregoing embodiment, but other magnetic field generating means may be also employed.

What is claimed is:

1. A developing apparatus, comprising:

a developing roller having a magnet roller for feeding a developer to a photoconductor, said magnet roller including plural magnetic poles for adsorbing the developer, a toner concentration sensor for detecting a toner concentration of said developer, a region (A) of said magnet roller corresponding to a location of said toner concentration sensor, said region being between two of said plural magnetic poles, said region having substantially zero gauss as a magnetic flux density distribution, said region (A) produced by forming said plural magnetic poles at specified positions of said magnet roller by magnetic fluxes of plural magnetic field generating means, and an additional magnetic field generating means disposed between a first and a second magnetic field generating means, said first and second magnetic field generating means magnetizing two areas at both sides of said region, and said additional magnetic field generating means disposed so as to repel a magnetic flux produced by the first magnetic field generating means and to attract a magnetic flux produced by the second magnetic field generating means, and thereby the magnetic flux density distribution produced by said first and second magnetic field generating means is altered so as to produce the substantially zero gauss region.

2. A developing apparatus according to claim 1, further comprising:

a developer height regulator disposed near said toner concentration sensor, wherein said toner concentration of said developer remaining on said developing roller after being cut off by said developer height regulator is detected by said toner concentration sensor.

3. A method for manufacturing a developing roller including a magnet roller for feeding a developer to a photoconductor, comprising:

forming a plurality of magnetic poles for adsorbing said developer at specified positions on said magnet roller by magnetic fluxes of plural magnetic field generating means wherein a region (A) of said magnet roller includes a substantially zero gauss magnetic flux density distribution, said region corresponding to a location of a toner concentration sensor for detecting a toner concentration of said developer between said plural magnetic poles;

magnetizing the magnet roller with an additional magnetic field generating means disposed between a first and second magnetic field generating means, said first and second magnetic field generating means magnetizing two areas at both sides of said region (A), and said additional magnetic field generating means disposed so as to repel a magnetic flux produced by the first magnetic field generating means and to attract a magnetic flux produced by the second magnetic field generating means, such that the magnetic flux density distribution produced by said first and second magnetic field generating means is altered so as to produce the substantially zero gauss region.

4. A method for manufacturing a developing roller according to claim 3, wherein said additional magnetic field generating means includes a soft iron electromagnetic yoke and an electromagnetic coil.

5. A developing apparatus, comprising:

a developing roller having a magnet roller for feeding a developer to a photoconductor, said magnet roller including plural magnetic poles for adsorbing the developer, a developer height regulator for defining the developer to be supplied to said photoconductor, a region (A) of said magnet roller corresponding to a location of said developer height regulator, said region being between two of said plural magnetic poles, and having substantially zero gauss as a magnetic flux density distribution, said region (A) produced by forming said plural magnetic poles at specified positions of said magnet roller by magnetic fluxes of plural magnetic field generating means, and an additional magnetic field generating means disposed between a first and second magnetic field generating means, said first and second magnetic field generating means magnetizing two areas at both sides of said region and said additional magnetic field generating means disposed so as to repel a magnetic flux produced by the first magnetic field generating means and to attract a magnetic flux produced by the second magnetic field generating means, and thereby the magnetic flux density distribution produced by said first and second magnetic field generating means being altered so as to produce the substantially zero gauss region.

6. A method for manufacturing a developing roller including a magnet roller for feeding a developer to a photoconductor, comprising:

forming a plurality of magnetic poles for adsorbing said developer at specified positions on said magnet roller by magnetic fluxes of plural magnetic field generating means, wherein a region (A) of said magnet roller includes a substantially zero gauss magnetic flux distribution, said region corresponding to a location of a developer height regulator for defining a height of said developer between said plural magnetic poles;

magnetizing with an additional magnetic field generating means disposed between a first and second magnetic field generating means, said first and second magnetic field generating means magnetizing two areas at both sides of said region (A), and said additional magnetic field generating means disposed so as to repel a magnetic flux produced by the first magnetic field generating means and to attract a magnetic flux produced by the second magnetic field generating means, such that the magnetic flux density distribution produced by said first and second magnetic field generating means is altered so as to produce the substantially zero gauss region.

7. A method for manufacturing a developing roller according to claim 6, wherein said additional magnetic field generating means includes a soft iron electromagnetic yoke and an electromagnetic coil.

* * * * *